US009908144B2

(12) United States Patent
Salminen et al.

(10) Patent No.: US 9,908,144 B2
(45) Date of Patent: Mar. 6, 2018

(54) COATED SUBSTRATE AND SYSTEM AND METHOD FOR MAKING THE SAME

(75) Inventors: Pekka Johannes Salminen, Freienbach (CH); Marco Edoardo Ahtinen, Zürich (CH); Arthas Bing Yang, Shanghai (CN)

(73) Assignee: Styron Europe GMBH, Horgen (CH)

( * ) Notice: Subject to any disclaimer, the term of this patent is extended or adjusted under 35 U.S.C. 154(b) by 568 days.

(21) Appl. No.: 14/402,379

(22) PCT Filed: Jun. 22, 2012

(86) PCT No.: PCT/EP2012/062107

§ 371 (c)(1),
(2), (4) Date: Nov. 20, 2014

(87) PCT Pub. No.: WO2013/189550

PCT Pub. Date: Dec. 27, 2013

(65) Prior Publication Data

US 2015/0111054 A1 Apr. 23, 2015

(51) Int. Cl.

| | |
|---|---|
| ***B05D 1/30*** | (2006.01) |
| ***D21H 23/48*** | (2006.01) |
| ***D21H 19/66*** | (2006.01) |
| ***D21H 19/72*** | (2006.01) |
| ***D21H 19/82*** | (2006.01) |
| ***D21H 21/16*** | (2006.01) |
| ***D21H 21/30*** | (2006.01) |
| ***B05C 5/00*** | (2006.01) |
| ***B05D 7/00*** | (2006.01) |
| ***D21H 19/38*** | (2006.01) |
| ***D21H 21/28*** | (2006.01) |

(52) U.S. Cl.

CPC ..... *B05D 1/305* (2013.01); *B05C 5/008* (2013.01); *B05D 7/50* (2013.01); *D21H 19/385* (2013.01); *D21H 19/66* (2013.01); *D21H 19/72* (2013.01); *D21H 19/82* (2013.01); *D21H 21/16* (2013.01); *D21H 21/28* (2013.01); *D21H 21/30* (2013.01); *D21H 23/48* (2013.01); *Y10T 428/31993* (2015.04)

(58) Field of Classification Search

CPC ..... B05D 1/305; B05D 5/008; B05D 7/50; D21H 19/385; D21H 19/66; D21H 19/72; D21H 19/82; D21H 21/16; D21H 21/28; D21H 21/30; D21H 23/48; Y10T 428/31993

USPC ..... 428/537.5

See application file for complete search history.

(56) References Cited

U.S. PATENT DOCUMENTS

| | | | | |
|---|---|---|---|---|
| 5,837,762 | A | 11/1998 | Stollmaier et al. | |
| 5,981,011 | A * | 11/1999 | Overcash | D21H 19/16 428/34.2 |
| 6,982,003 | B2 | 1/2006 | Gueggi et al. | |
| 7,101,592 | B2 | 9/2006 | Gueggi et al. | |
| 7,169,445 | B2 | 1/2007 | Gueggi | |
| 7,425,246 | B2 | 9/2008 | Urscheler | |
| 7,473,333 | B2 | 1/2009 | Urscheler et al. | |
| 7,608,668 | B2 | 10/2009 | Li Pi Shan et al. | |
| 7,858,706 | B2 | 11/2010 | Arriola et al. | |
| 2004/0121080 | A1 * | 6/2004 | Urscheler | B05D 1/305 427/420 |

FOREIGN PATENT DOCUMENTS

| | | | |
|---|---|---|---|
| CN | 1500563 | * | 6/2004 |
| CN | 1500563 | A | 6/2004 |
| WO | 2004/035929 | A1 | 4/2004 |
| WO | WO2004/035929 | * | 4/2004 |
| WO | 2006/007239 | A2 | 1/2006 |
| WO | WO2006/007239 | * | 1/2006 |
| WO | 2009/042371 | A1 | 4/2009 |
| WO | 2010/042162 | A1 | 4/2010 |

OTHER PUBLICATIONS

Second Office Action from the State Intellectual Property Office of the People's Republic of China for Application No. 201280073350.X, dated Jun. 8, 2016.

European Patent Office Communication dated Aug. 16, 2016 for Application No. 12732814.4-1308.

International Search Report and Written Opinion, Serial No. PCT/EP2012/062107, dated Feb. 19, 2013, Published as WO2013/189550.

Chinese Third Office Action dated Nov. 28, 2016 for Application No. 201280073350.X.

* cited by examiner

*Primary Examiner* — Leszek Kiliman

(74) *Attorney, Agent, or Firm* — The Dobrusin Law Firm, P.C.; Daniel P. Aleksynas

(57) ABSTRACT

A coated paperboard (100) comprising: a base substrate (102) having a brightness of about 65 or less measured using TAPPI T452 and a coating (104) on at least one side of the base substrate, wherein the base substrate comprises: one or more opaque layers (114) including a white filler, wherein the opaque layer covers the base substrate so that visibility of the base substrate through the opaque layer is substantially eliminated; a barrier layer (116) covering the opaque layer; wherein the barrier layer substantially prevents aqueous fluids from contacting the opaque layer, and wherein the coated paperboard has a brightness on the side of the base substrate with the coating of about 65 or more measured using TAPPI T452, and a wet brightness drop, on the side of the base substrate with the coating, of about 30 or less, measured using the wet brightness drop test.

20 Claims, 4 Drawing Sheets

COATED SUBSTRATE AND SYSTEM AND METHOD FOR MAKING THE SAME

FIELD

The present teachings relate to a coated substrate with desirable optical properties and specifically a coated paperboard that retains the desirable optical properties when water is applied to the coating.

BACKGROUND

The present teachings are predicated upon providing a system and method for producing a low cost coated paperboard with desirable optical properties that substantially retains its optical properties such as brightness when the coating is wetted. Generally, paperboard may include one or more brown layers. The brown layers may be covered by one or more lighter layers such as a white fiber layer and the lighter layers may be covered by one or more coating layers. Currently the cost of purchasing the white fiber is increasing and there is increasing pressure to lower the cost of the coated paperboard. One way to lower the cost of the paperboard is by removing the white fiber layer. Attempts have been made to remove the white fiber layer from the coated paperboard; however, when the white fiber layer is not applied between the brown layer and the coating layer, the brown layer may be visible through the coating layer, the brown layer may become visible through the coating layer when water is applied to the coating layer, or both. Visibility of the brown layers through the coating layers deteriorates the optical properties and causes the coated paperboard to be rejected or sold at a reduced price.

Examples of devices, methods, and/or compositions used to coat paperboard may be found in U.S. Pat. Nos. 5,837,762; 6,982,003; 7,101,592; 7,169,445; 7,425,246; 7,473,333 and International Patent Application Nos. WO2009/042371 and WO2010/042162 all of which are incorporated by reference herein for all purposes. In one example, U.S. Pat. No. 7,425,246 discusses a concept where desired properties are achieved by coating board with a combination of an interface (i.e., under) and internal (i.e., over) layers of similar coat weight. The present teachings seek to solve these problems by proving a system and method for producing a coated paperboard with desirable optical properties that has reduced amounts and/or is free of a bright fiber layer or a white fiber layer and retains its optical properties when water is applied to the coating. It would be attractive to have an improved coated paperboard that retains its optical properties when water is applied to the coating. It would be attractive to have a system and method for applying an opaque layer and a barrier layer simultaneously so that the opaque layer is protected by the barrier layer and the paperboard retains its desirable optical properties and an improved coating is provided on the paperboard.

SUMMARY

The present teachings provide: a coated paperboard comprising: a base substrate having a brightness of about 65 or less measured using TAPPI T452 and a coating on at least one side of the base substrate, wherein the base substrate comprises: one or more opaque layers including a white filler, wherein the opaque layer covers the base substrate so that visibility of the base substrate through the opaque layer is substantially eliminated; a barrier layer covering the opaque layer; wherein the barrier layer substantially prevents aqueous fluids from contacting the opaque layer, and wherein the coated paperboard has a brightness on the side of the base substrate with the coating of about 65 or more measured using TAPPI T452, and a wet brightness drop, on the side of the base substrate with the coating, of about 30 or less, measured using the wet brightness drop test.

The present teachings provide a process comprising: forming a multilayer free flowing curtain; coating the base substrate with the multilayer free flowing curtain so that as the base substrate moves into contact with the free flowing curtain and the multilayer free flowing curtain coats the base substrate forming the coated paperboard of the teachings herein.

The present teachings provide a system for coating a base substrate comprising: a transport system for feeding a base substrate, having a brightness of about 65 or less measured using TAPPI T452, along a path of travel; a multilayer curtain coating system comprising: a plurality of free flowing liquid curtains disposed adjacent to the path of travel for forming a coating, wherein coating includes: a first liquid curtain having a first coating material and a second liquid curtain located downstream of the first liquid coating in the path of travel, the second liquid curtain having a second coating material; an engagement system for selectively bringing the base substrate and the plurality of free flowing liquid curtains into contact; and wherein the first liquid curtain coats the base substrate and forms an opaque layer and the second liquid curtain coats the opaque layer and forms a barrier layer; wherein the barrier layer substantially prevents aqueous fluids from contacting the opaque layer; and wherein the coated base substrate has a brightness on the side of the base substrate with the coating of about 65 or more measured using TAPPI T452, and a wet brightness drop, on the side of the base substrate with the coating, of about 30 or less, measured using the wet brightness drop test.

The teachings herein surprisingly solve one or more of these problems by providing an improved coated paperboard that retains its optical properties when water is applied to the coating. The teachings provide a system and method for applying an opaque layer and a barrier layer substantially simultaneously so that the opaque layer is protected by the barrier layer and the paperboard retains its desirable optical properties.

DETAILED DESCRIPTION

Figure 1:
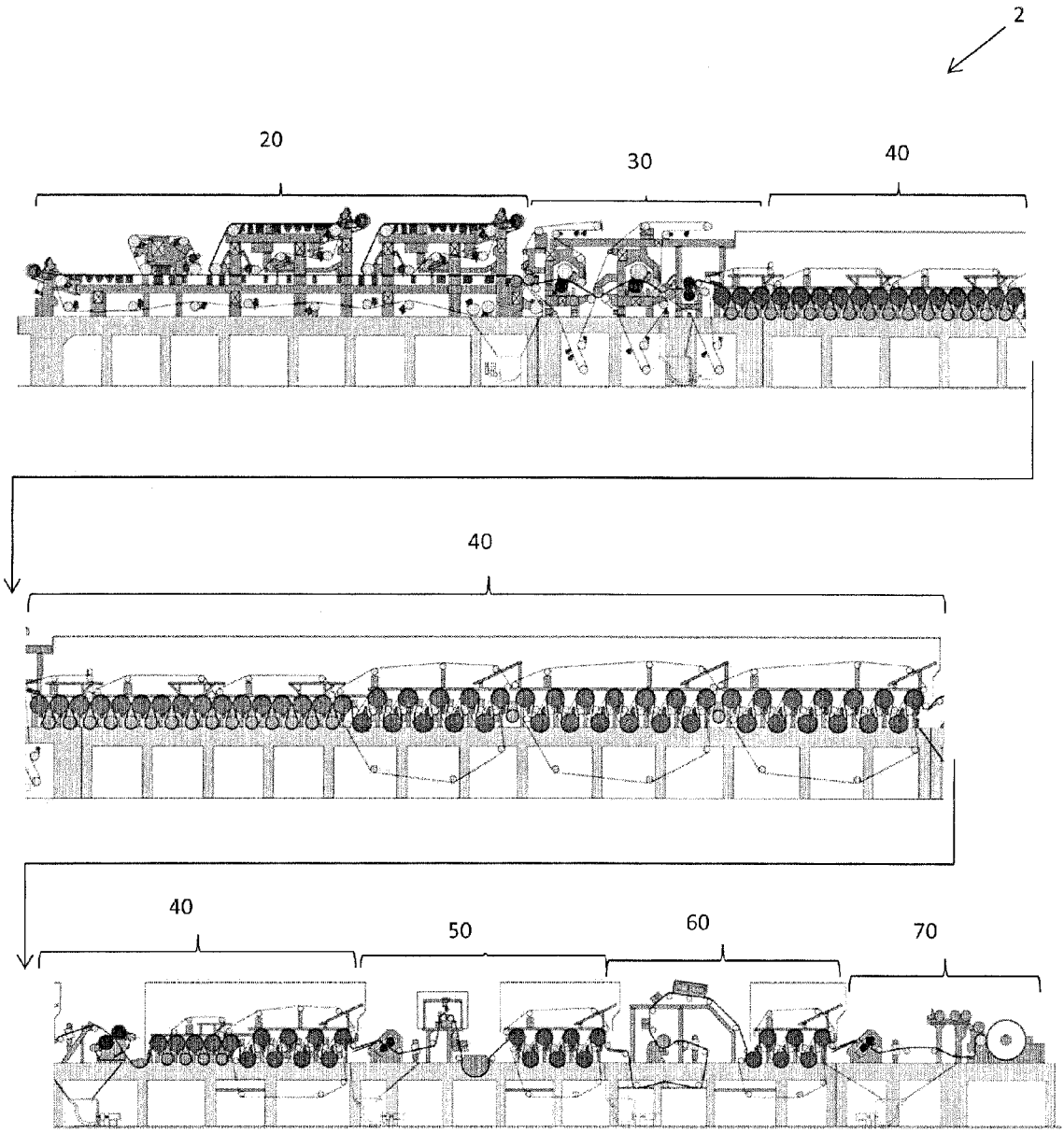
FIG. 1 illustrates one example; of a full paper machine including the system as taught herein.

The explanations and illustrations presented herein are intended to acquaint others skilled in the art with the teachings, its principles, and its practical application. Those skilled in the art may adapt and apply the teachings in its numerous forms, as may be best suited to the requirements of a particular use. Specific embodiments of the present teachings as set forth are not intended as being exhaustive or limiting. The scope of the teachings should be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings include coated paperboards with desirable optical properties that are free of a higher brightness fiber layer covering a lower brightness fiber layer. The lower brightness fiber layer (i.e., non-white fiber layer) may be a brown material, a recycled material, a virgin material, a mechanical pulp, a chemical pulp, or a combination thereof. Preferably, the lower brightness fiber layer is part of a base substrate of the coated paperboard. The coated paperboard of the teachings herein may have a reduced content and/or be substantially free of discernible white fibers over a brown base substrate fiber layer. The coated paperboard of the teachings herein includes at least a base substrate, an opaque layer, and a barrier layer. The base substrate may be any low cost layer that may support a coating. The low cost layer may be a low brightness layer. The base substrate may have a brightness (β) when measured using TAPPI T452. The brightness (β) may be about 65 or less, about 60 or less, about 50 or less, about 40 or less, or about 30 or less when measured using TAPPI T452. The base substrate may have brightness (β) from about 10 to about 65, from about 20 to about 50, or from about 30 to about 40 when measured using TAPPI T452. Preferably, the base substrate may be made of a high content of non-white fibers. The non-white fibers may be virgin, recycled, or both. The base layer may be primarily made of non-white fibers such as old corrugated containers (OCC), mixed office waste, virgin kraft, mechanical pulp, chemical pulp, thermomechanical pulp, newspaper, post-industrial, post-consumer, magazines, copy paper, or a combination thereof (e.g., about 20 percent by weight or more, about 50 percent by weight or more, about 70 percent or more, about 85 percent by weight or more, or about 92 percent by weight or more). The base substrate may be free of added lighter fibers, fillers, or both (i.e., light fibers or fillers not present in the non-white fibers discussed herein). Preferably, the base substrate has low amounts of bleached kraft paper, deinked pulp, mixed office waste, white fibers, or a combination thereof (i.e., 40 percent by weight or less, preferably 10 percent by weight or less, or more preferably about 5 percent by weight or less, or even more preferably about 1 percent by weight or less). More preferably, the base substrate is free of a light layer of fibers (e.g., bleached kraft paper and/or pulp, deinked pulp, mixed office waste, white fibers, or a combination thereof) over the brown fiber layers. The base substrate may include a precoating, a precoating layer, or both.

The precoating may be any coating that is directly applied to the base substrate and becomes part of the base substrate. The base substrate may be free of a precoating. The precoating may be any layer that improves the physical properties of the final coated paperboard. The precoating may be any thin non-fibrous coating layer that forms a layer over the base substrate. The precoating may be any coating that has a higher brightness than the base substrate. The precoating and base substrate may have a brightness (β') when measured using TAPPI T452. The precoating may be any coating that may have a brightness β' that is about β or more, preferably about β+5 or more, or more preferably about β+10 or more when measured using TAPPI T452. The precoating may have a brightness β' of about β+40 or less, about β+30 or less, or about β+20 or less when measured using TAPPI T452. The precoating may be made of any composition that increases the brightness of the base substrate when the precoating is applied to the base substrate. The precoating may be made of the same material as the opaque layer, the barrier layer, or both. Preferably, the precoating is made of different materials as the opaque layer, the barrier layer, or both. The precoating and the opaque layer, the barrier layer, or both may have some materials that overlap. Preferably, the precoating is substantially free of fibers. More preferably, the precoating is made of clay, calcium carbonate, titaniumoxide, or a combination thereof and binders and additives. The precoating may be applied to the base substrate before, during, or both application of the one or more coating layers. The precoating layer may be any layer that is applied to the base substrate to form a smooth surface, provide a higher brightness surface than the brown fiber layer, improve optical properties, or a combination thereof so that one or more coating layers may be applied to the base substrate for forming a coated paperboard as taught herein.

The coating layer may be any layers that are applied over the base substrate so that optical properties of the base substrate are improved (e.g., the coating layer may be any layer applied over the brown fiber layer or a brown fiber layer and precoating). The coating may be two or more layers that are applied simultaneously, sequentially, or both. Preferably, the coating is at least two layers that are applied substantially simultaneously to the base substrate, the precoated layer, or both. The coating layer may be any layer that provides a high brightness, a low brightness drop, or both as discussed herein. The at least two layers are at least an opaque layer and a barrier layer.

The opaque layer may be any layer that has a high opacity so that the lower brightness layers of the base substrate do not show through the coating layers. The opaque layer may be any layer that provides sufficient coverage so that the base substrate is substantially blocked from view (i.e., visibility of the base substrate is substantially eliminated). Preferably the opaque layer provides sufficient coverage so that the base substrate is completely blocked from view. The opaque layer may have a sufficient coat weight so that the opaque layer substantially blocks or completely blocks the base substrate from visibility. The opaque layer may have a coat weight of about 6 $g/m^2$ or more, preferably about 15 $g/m^2$, more preferably about 18 $g/m^2$, or most preferably about 20 $g/m^2$ or more. The opaque layer may have a coat weight of about 40 $g/m^2$ or less, about 35 $g/m^2$ or less, or about 30 $g/m^2$ or less. The opaque layer may have a coat weight from about 6 $g/m^2$ to about 40 $g/m^2$, preferably from about 12 $g/m^2$ to about 30 $g/m^2$, or more preferably from about 15 $g/m^2$ to about 22 $g/m^2$. The opaque layer may increase the brightness of the coated paperboard. The opaque layer when applied to the base substrate may have optical properties so that the brightness (θ) of the paperboard with the opaque layer is about 65 or higher, preferably about 70 or higher, more preferably about 80 or higher, or even more preferably about 82 or higher. The brightness (θ) of the coated paperboard with the opaque layer may be about 100 or less, about 95 or less, or about 90 or less. The paperboard with the opaque layer may have a brightness (θ) of about β or β' or more, about (β or β')+5 or more, about (β or β')+10 or more, preferably about (β or β')+15, more preferably about (β or β')+20 or more, even more preferably about (β or β')+30 or more, or most preferably about (β or β')+40 or more measured using TAPPI T425. The opaque layer may be comprised of one or more layers, one or more materials, or a combination thereof so that the opaque layer provides sufficient coverage to substantially reduce and/or eliminate visibility of the base substrate. The opaque layer may be formed by formulating one or more coating layers together. The opaque layer may formulate one or more layers together while maintaining their functions. The opaque layer may be formulated to provide the properties of the combined use of an under layer and an over layer.

The opaque layer may be free of under layer properties, over layer properties, or both. Preferably, the opaque layer may include under layer properties, over layer properties, or both that assist in adhering the opaque layer to the base substrate, increases the opacity of the opaque layer, or both. The opaque layer may incorporate under layer properties, over layer properties, or both that may promote wetting of the base substrate during the application of the coating. The opaque layer may incorporate under layer properties, over layer properties, or both that may provide wetting, improve functional performance such as adhesion, sizing, stiffness, or a combination of functions. The opaque layer may incorporate under layer properties, over layer properties, or both that may increase the opacity of the opaque layer. The opaque layer may incorporate one or more components discussed herein to incorporate one or more properties of the under layer, over layer, or both.

The opaque layer may include one or more of the following: clay, kaolin, talc, calcium carbonate, titanium dioxide, satin white, synthetic polymer pigment, zinc oxide, bariumsulphate, gypsum, silica, alumina trihydrate, mica, diatomaceous earth, and other mineral pigments, an optical brightener, a binder, polyvinyl alcohol, and other additives.

The opaque layer will be covered by a barrier layer. The barrier layer may be any layer that covers the opaque layer so that the opaque layer substantially maintains and/or maintains its optical properties. The barrier layer may prevent or completely prevent fluids from contacting the opaque layer. Preferably, the barrier layer may substantially prevent or completely prevent aqueous fluids from contacting the opaque layer. The fluids may include water, alcohol, oil, a solvent, or a combination thereof. The barrier layer may be hydrophobic or non-porous so that the barrier layer is resistant to penetration by water, alcohol, oil resistant, solvent resistant, or a combination thereof. Preferably, the barrier layer prevents capillary action or diffusion from moving an aqueous fluid to the opaque layer so that that brightness of the opaque layer is not reduced by the presence of such fluids.

The barrier layer may be made of any material that protects the opaque layer form aqueous fluids. The barrier layer may be hydrophobic film forming resin that forms a film that does not allow absorption of the aqueous fluids to penetrate the barrier layer. The barrier layer may be made of any material that may be applied as a thin film over the opaque layer. Preferably, the barrier layer may be any layer that may prevent an aqueous fluid from penetrating into the opaque layer, but printing (e.g., text, graphics, or some combination thereof) may be applied to the barrier layer or a top coat layer. The barrier layer may be made of latex, rubber, styrene butadiene, or mixtures thereof.

For the various embodiments, latexes that provide for good film formation without tackiness or stickiness are preferred. Examples of such latexes for use in the first coating composition can be selected from a group consisting of styrene-butadiene latexes, styrene-acrylate latexes, styrene-acrylic latexes, styrene maleic anhydrides, styrene-butadiene acrylonitrile latexes, styrene-acrylate-vinyl acrylonitrile latexes, vinyl acetate latexes, vinyl acetate-butyl acrylate latexes, vinyl acetate-ethylene latexes, acrylic latexes, vinyl acetate-acrylate latexes, acrylate copolymers, vinylidene-containing latexes, vinylidene chloride/vinyl chloride containing latexes and a mixtures thereof. Carboxylated versions of several of the above latexes are also possible, where the latexes are prepared by copolymerizing the monomers with a carboxylic acid such as, for example, acrylic acid, methacrylic acid, itaconic acid, maleic acid, fumaric acid, the like, or a combination thereof. Other possible latexes for use in the first coating composition can also include those latexes described in U.S. Pat. Nos. 4,468,498 and 6,896,905, incorporated herein by reference.

In addition to the latexes mentioned above, the first coating composition used to form the water vapor barrier layer can include polysaccharides, proteins, polyvinyl pyrrolidone, polyvinyl alcohol, polyvinyl acetate, cellulose and cellulose derivatives, epoxyacrylates, polyester, polyester-acrylates, polyurethanes, polyetheracrylates, oleoresins, nitrocellulose, polyamide, vinyl copolymers, various forms of polyacrylates, and copolymers of vinyl acetate, (meth) acrylic acid and vinyl versatate. Further, the coating composition of the present disclosure can further include at least one or more base polymers selected from the group of thermoplastic resins including homopolymers and copolymers (including elastomers) of an alpha-olefin such as ethylene, propylene, 1-butene, 3-methyl-I-butane, 4-methyl-I-pentene, 3-methyl-I-pentene, 1-heptene, 1-hexene, 1-octene, 1-decene, and 1-dodecene as typically represented by polyethylene, polypropylene, poly-1-butene, poly-3-methyl-I-butene, poly-3-methyl-I-pentene, poly-4-methyl-1-pentene, ethylene-propylene copolymer, ethylene-1-butane copolymer, and propylene-1-butene copolymer; copolymers (including elastomers) of an alpha-olefin with a conjugated or non-conjugated diene as typically represented by ethylene-butadiene copolymer and ethylene-ethylidene norbornene copolymer; and polyolefins (including elastomers) such as copolymers of two or more I alpha-olefins with a conjugated or non-conjugated diene as typically represented by ethylene-propylene-butadiene copolymer, ethylene-propylene-dicyclopentadiene copolymer, ethylene-propylene-1,5-hexadiene copolymer, and ethylene-propylene ethylidene norbornene copolymer; ethylene-vinyl compound copolymers such as ethylene-vinyl acetate copolymer, ethylene-vinyl alcohol copolymer, ethylene-vinyl chloride copolymer, ethylene acrylic acid or ethylene-(meth)acrylic acid copolymers, and ethylene-(meth)acrylate copolymer; styrenic copolymers (including elastomers) such as polystyrene, ABS, acrylonitrile-styrene copolymer, ot-methylsryrene-styrene copolymer; and styrene block copolymers (including elastomers) such as styrene-butadiene copolymer and hydrate thereof, and styrene-isoprene-styrene triblock copolymer; polyvinyl compounds such as polyvinyl chloride, polyvinylidene chloride, vinyl chloride vinylidene chloride copolymer, polymethyl acrylate, and polymethyl methacrylate; polyamides such as nylon 6, nylon 6,6, and nylon 12; thermoplastic polyesters such as polyethylene terephthalate and polybutylene terephthalate; polycarbonate, polyphenylene oxide, and the like. These resins may be used either alone or in combinations of two or more. Additionally, olefin block copolymers, such as those described in U.S. Pat. Nos. 7,858,706 and 7,608,668, may also be used as a base polymer, both incorporated by reference herein. As used herein, the term "copolymer" refers to a polymer formed of two or more comonomers. In particular embodiments, polyolefins such as polypropylene, polyethylene, copolymers thereof, and blends thereof, as well as ethylene-propylene-diene terpolymers can be the base polymer included in the coating composition. The coating composition can also include at least one or more stabilizing agent and a fluid medium for forming the coating composition. The barrier layer may include one or more hydrophobic layers, one or more hydrophobic materials, or both. The hydrophobic layer and/or hydrophobic materials may be any layer and/or material that prevents water from penetrating through the barrier layer, into the opaque layer, or both. The hydrophobic layer, hydrophobic materials, or both may be wax, alkyl ketene dimer (AKD), a sizing agent, silicone, polytetrafluroethylene (PTFE), polyvinylflouride (PVF), polyvinylidene fluoride (PVDF), polychlorotrifluoroethylene (PCTFE), perfluroalkoxy polymer (PFA), fluorinated ethylene-proylene (FEP), polyethylenetetrafluroethylene (ETFE), polyethylenechlorotrifluoroethylene (ECTFE), Perlfluorinated Elastomer Perfluoroelastomer (FFPM), perfluropolyether (PFPE), or a combination thereof.

The barrier layer as discussed herein may employ one or more of the materials discussed herein so that brightness drop of the opaque layer is minimized. The barrier layer may include a mineral pigment. The mineral pigment may be clay, kaolin, talc, calcium carbonate, titanium dioxide, satin white, synthetic polymer pigment, zinc oxide, bariumsulphate, gypsum, silica, alumina trihydrate, mica, diatomaceous earth, or a combination thereof. The barrier layer may be about 80 percent by weight pigment or less, about 50 percent by weight pigment or less, about 40 percent by weight pigment or less, about 20 percent by weight pigment or less, or even substantially about 0 percent by weight pigment. The barrier layer may include any of the mineral pigments discussed herein for the opaque layers. The barrier layer may help to protect the opaque layer so that wet brightness drop tests result in a brightness drop of about 30 or less, preferably about 20 or less, more preferably about 15 or less, even more preferably about 10 or less, or most preferably about 5 or less. The barrier layer may be applied in a sufficient amount so that the barrier layer is resistant to penetration of an aqueous fluid. Preferably, the barrier layer may be applied in a sufficient amount so that the barrier layer is resistant to penetration by an aqueous fluid and the optical properties of the opaque layer are substantially maintained and/or free of derogation. For example, when the barrier layer is applied over the opaque layer the brightness of the opaque layer may be reduced by 8 or less, 5 or less, 3 or less, or 1 or less when measured using TAPPI T452 (i.e., the barrier layer does not substantially affect the optical properties of the opaque layer). The barrier layer may have a sufficient coat weight so that the barrier layer prevents wetting of the opaque layer. The coat weight of the barrier layer may be about 0.1 $g/m^2$ or more, about 0.5 $g/m^2$ or more, about 1 $g/m^2$ or more, about 2 $g/m^2$ or more, or about 3 $g/m^2$ or more. The coat weight of the barrier layer may be about 10 $g/m^2$ or less, preferably about 7 $g/m^2$ or less, more preferably about 5 $g/m^2$ or less, or even more preferably about 2 $g/m^2$ or less. The brightness of the coated paperboard with the opaque layer and the barrier layer may be substantially the same brightness as the paperboard coated with just the opaque layer (i.e., the barrier layer does not substantially increase or decrease the brightness of the coated paperboard).

A top coat layer may be applied over the barrier layer. The top coat layer may be applied to the paperboard at the same time as the barrier layer and the opaque layer. Preferably, the top coat layer may be applied in a separate step. More preferably, the top coat layer may be applied using a metering blade so that the final coated paperboard has a smooth surface. The top coat may be any layer that increases the gloss, the smoothness, or both of the coated paperboard. The coated paperboard with the top coat layer may have a brightness of "τ." The brightness (τ) of the coated paperboard with the top coat layer may be about θ, about θ+5 or more, about θ+10 or more, about θ+20 or more, or about θ+30 or more. The brightness (τ) of the coated paperboard with the top coat layer may be about θ+50 or less, about θ+40 or less, or about θ+30 or less. The top coat layer may be applied in a sufficient amount so that the top coat provides: a smooth printing surface, the top coat increases the brightness of the paperboard to a brightness level discussed herein, surface smoothness, gloss, printability, board mechanical properties, or a combination thereof. The top coat may be applied with a sufficient coat weight so that the opaque layer and the barrier layer are covered and base substrate is completely blocked from view when the coating is wet or dry. The top coat may have a coat weight of about 5 $g/m^2$ or more, about 7 $g/m^2$ or more, about 9 $g/m^2$ or more, or about 10 $g/m^2$ or more. The top coat may have coat weight of about 30 $g/m^2$ or less, about 20 $g/m^2$ or less, about 15 $g/m^2$ or less, or about 12 $g/m^2$ or less. The top coat may be made of any material that will result in the paperboard having desired surface properties. The top coat may include clay, titanium dioxide, calcium carbonate, delaminated clay, a whitener, an optical brightener, a binder, styrene butadiene, polyvinyl alcohol, or a combination thereof.

The opaque layer includes at least a white filler and a binder. The white filler may be any white filler that exhibits a high brightness when applied to the base substrate taught herein. The white filler may be a clay, kaolin, talc, calcium carbonate, titanium dioxide, satin white, synthetic polymer pigment, zinc oxide, bariumsulphate, gypsum, silica, alumina trihydrate, mica, and diatomaceous earth, or a combination thereof. An example of one exemplary fine clay is sold under the name HG90 available from KaMin LLC. An example of one exemplary delaminated clay is sold under the name Capim NP available from Cameo Chemicals. An example of an exemplary calcium carbonate is sold under the name Hydrocarb 90 available from Omya. An example of an exemplary titanium dioxide is sold under the name Kronos 4045 available from Kronos Titan Gmbh. The binder may be any binder that adheres the white filler together and bonds the white filler to the base substrate. The binder may be any binder that may adhere the white filler to the paperboard. The binder may be a laytex, a polyvinyl alcohol, a styrene butadiene, or a combination thereof. One exemplary polyvinyl alcohol is sold under the name Mowiol 6-98 available from Kuraray America Inc. Two exemplary binders that may be used are Styrene Butadiene based emulsions such as MLE4102 and MLE4001 available from Stryon LLC. One exemplary optical brightener that may be used is available under the name Leucophor UP available from Zhejiang Hondga Chemical Co. Ltd. The materials discussed herein may be applied to the base substrate in any concentration so that the final coated paperboard exhibits a high brightness and a low brightness drop when wet.

The top coat, precoat, or both includes at least a white filler and a binder. The top coat, the precoat, or both may be any film that may be applied to the paperboard to vary the optical properties of the paperboard. The white filler may be any white filler that exhibits a high brightness when applied to the base substrate taught herein. The white filler may be a clay, kaolin, talc, calcium carbonate, titanium dioxide, satin white, synthetic polymer pigment, zinc oxide, bariumsulphate, gypsum, silica, alumina trihydrate, mica, and diatomaceous earth, or a combination thereof. An example of one exemplary fine clay is sold under the name HG90 available from KaMin LLC. An example of one exemplary delaminated clay is sold under the name Capim NP available from Cameo Chemicals. An example of an exemplary calcium carbonate is sold under the name Hydrocarb 90 available from Omya. An example of an exemplary titanium dioxide is sold under the name Kronos 4045 available from Kronos Titan Gmbh. The binder may be any binder that adheres the white filler together and bonds the white filler to the base substrate. The binder may be a laytex, a polyvinyl alcohol, a styrene butadiene, or a combination thereof. One exemplary latex is a Styrene Butadiene based emulsions sold under the name DL1065 available from Styron LLC. One exemplary polyvinyl alcohol is sold under the name Mowiol 6-98 available from Kuraray America Inc. One exemplary optical brightener that may be used is available under the name Leucophor UP available from Zhejiang Hondga Chemical Co. Ltd. The materials discussed herein may be applied to the base substrate in any concentration so that the final coated paperboard exhibits a high brightness and a low brightness drop when wet.

The final coated paperboard may have a brightness of about 65 or more, about 70 or more, about 80 or more, preferably about 90 or more, more preferably about 92 or more, or most preferably about 93 or more measured using TAPPI T452. The final paperboard may have a brightness of about 100 or less, about 898 or less, or about 95 or less measured using TAPPI T452. The brightness of the final coated paperboard may have a wet brightness drop when water is placed on the coating. Preferably the wet brightness drop is small so that the naked eye cannot determine the difference in brightness when comparing a wetted sample and a dry sample. Preferably, the wet brightness drop at 30 seconds is substantially equal to 1 or less such that the drop is brightness is not detectable by the naked eye. The wet brightness drop may be about 30 or less, about 20 or less, about 15 or less, preferably about 10 or less, more preferably about 8 or less, even more preferably about 5 or less, or most preferably about 3 or less when measured using the brightness drop test discussed herein. The brightness drop may be about 0.5 or more, about 1 or more, or about 2 or more when measured using the brightness drop test discussed herein. In a most preferred embodiment the wet brightness drop would be substantially zero. The brightness drop as discussed herein is the difference between the brightness of the final coated paperboard and the brightness of the final coated paperboard when water is applied to the coating. For example, if the final coated paperboard has a brightness of 100 and a brightness drop of 20 the brightness of the final coated paperboard when wet is about 80. The wet brightness drop test is performed using the method discussed herein.

The wet brightness drop test is a combination of the brightness test using TAPPI T452 and wetting the paper by applying an aqueous liquid under the standards of a Cobb test performed using TAPPI T441. In one example, an initial brightness is measured using TAPPI T452 and then a Cobb test is performed using TAPPI T452 so that the coating is wetted. Once the Cobb test is complete the brightness value is measured again and the difference between the two brightness readings is the brightness drop. A more specific example, of how the test is performed is listed below in Table 1.

TABLE 1

| WET BRIGHTNESS DROP TEST | |
|---|---|
| 1 | Sample Preparation |
| | a) Obtain test samples that are free from folds, wrinkles, or other blemishes. |
| | b) Condition the paper in an atmosphere of 50% ± 2.0% relative humidity and 23° C. ± 1.0° C. for 24 h. |
| | c) Test the paper in the same atmosphere. |
| | d) Cut four squares of each test sample. |
| | Method 1 |
| | Sample Size 13 $cm^2$ |
| | Amount of water 100 mL |
| | Wetting Time 30 seconds |
| 2 | Measure the Brightness of each sample and average Brightness measurements this will equal ($B_{dry}$). |
| | Notes: 4 Brightness readings are measured on every square of each test sample, thus, 16 ISO Brightness readings are needed for each test sample. |
| 3 | Place the sample on the rubber mat of the Cobb apparatus with the coated side facing up. |
| 4 | Center the metal ring on the sample and fasten it firmly with the crossbar to prevent leakage. |
| 5 | Pour the specified amount of water (i.e., 100 ml) into the ring as rapidly as possible and start the stopwatch/timer immediately. |
| 6 | At the expiration of the predetermined test period (30 seconds), pour the water from the ring. |
| | Note: take care not to drop any of the water upon the outside portion of the test sample. |
| 7 | Promptly loosen the wing nuts and swing the crossbar out of the way while holding the ring in position by pressing it down with one hand. |
| 8 | Carefully, but quickly, remove the ring and place the test sample with its wetted side up on a sheet of blotting paper resting on a flat rigid surface. |
| 9 | At 10 s after expiration of the predetermined test period, place a second sheet of blotting paper on top of the sample. Quickly Remove the surplus water by moving the roller once forward and once back over the pad without adding any extra pressure. |
| 10 | At 15 seconds after expiration of the predetermined test period, quickly measure the Brightness of wetted sample. |
| | Notes: Only one Brightness reading is needed for each wetted sample as the brightness increases fast with evaporation of water. |
| 11 | Repeat from step 4 to 10 for the other three squares of test sample to get the average Brightness of wetted sample-$B_{wet}$. |
| 12 | If more test samples need to be measured, repeat from Step 4 to 13. |
| 13 | $B_{dry} - B_{wet}$ = Brightness Drop |

The coated paperboard as taught herein may undergo a Fold Crack Area Ratio Test (FCAR). The FCAR is performed using the test method listed in Table 2.

TABLE 2

| Fold Crack Area Ratio Test (FCAR) |
|---|
| 1. Sample Preparation<br>a) Obtain test samples that are free from folds, wrinkles, or other blemishes.<br>b) Condition the paper in an atmosphere of 50% ± 2.0% relative humidity and 23° C. ± 1.0° C. for 24 h.<br>c) Test the paper in the same atmosphere. |
| 2. Color the surface of each sample black using a black ink such as Grade SMX 15 manufactured by Toyo Ink so that an area of about 180 $cm^2$ (e.g., about 53 mm × 340 mm) is covered. |
| 3. Fold the paper and feed the paper through a nip of a test printer available from Prufbau. The fold line is created using a constant load of about 625N. |
| 4. Photograph the folds at a magnification of 7.1X so that a standard area of about 2.0 $cm^2$ on the paper surface is visible in the photograph. |
| 5. Measure the areas of the white regions in the photographs. |
| 6. Calculate the fold crack area with the following formula.<br>$\text{Fold Crack Area Ratio} = \frac{\text{TotalAreaofWhiteRegions}}{\text{Total Area of the Photograph}}$ |

A process of making the coated paperboard of the present teachings includes at least a step of forming a multilayer free flowing curtain and a step of coating the base substrate with the multilayer free flowing curtain. The multilayer free flowing curtain includes at least two layers. A first layer is an opaque layer and the second layer is a barrier layer. The opaque layer and the barrier layer may be applied substantially simultaneously or sequentially. The opaque layer and the barrier layer are applied so that the opaque layer contacts that base substrate and then the barrier layer covers the opaque layer so that the opaque layer is protected. The opaque layer may be a single coating formulation. Preferably, the opaque layer may be a combination of at least two coating formulations designed so that when applied the opaque layer retains the function of both layers. For example, an under layer and an over layer may be formulated together and applied to the base substrate. The opaque layer and the barrier layer may remain laterally and/or longitudinally static as the base substrate moves underneath the coatings so that the coatings coat the base substrate (i.e., the opaque layer and barrier layer move vertically).

During the process of coating the base substrate is moving in a machine direction so that the free flowing curtain continuously coats the base substrate. The base substrate may be moving at any speed so that the multilayer free flowing curtain evenly covers the base substrate and so that the coat weights discussed herein are achieved. The base substrate may move at 200 m/s or more, 500 m/s or more, 1000 m/s or more, or 2500 m/s or more. The base substrate may be move at 5000 m/s or less, 4500 m/s or less, or about 4000 m/s or less. The free flowing curtain may overflow out of a multilayer curtain coating unit. Preferably, the coating is displaced and overflows out of the multilayer curtain coating unit as additional coating is pumped into the multilayer curtain coating unit. Thus, the coat weight applied to base substrate is a product of machine speed and pump speed displacing the coating from the multilayer curtain coating unit. The opaque layer and the barrier layer may be covered by a top coat.

The top coat may be applied at the same time as the opaque layer and the barrier layer. Preferably, the top coat is applied after the opaque layer and the barrier layer are applied. More preferably, the top coat is applied using a metering blade so that the final coated paperboard has a smooth surface for printing. The paperboard may go through one or more processing steps after the opaque layer, the barrier layer, the top coat, or a combination thereof are applied.

The coated paperboard may be calendered. The coated paperboard may be dry calendered, wet calendered, or both. The coating layers may be surface treated. Those skilled in the art will recognize that the present invention provides a cost effective alternative for the creation of a coated paperboard suitable for the packaging industry. The coated paperboard of the present invention is suitable to receive quality printing applications and retain its strength in demanding environments, such as: rain, snow, and high humidity. In the most preferred embodiment, the coated paperboard of the present teachings reduces costs by eliminating the high cost of the white fiber layer.

Those skilled in the art will recognize that the most preferred embodiments of present invention are tailored toward characteristics important to the packaging industry, namely, cost, print performance, strength, resistance to fluids and fold ability. To create packages for consumer products, coated paperboard is often printed, die cut and then folded into desired configurations. It is important that the fold lines in the coated paperboard do not exhibit cracking and the coating layers retain their beneficial properties.

FIG. 1 illustrates a paper machine 2. One exemplary example of a paper machine 2 that may be used with the present teachings is found in FIG. 1 available at http://www.voith.com/en/products-services/paper/process-steps/paper-machines-10484.html. The paper machine 2 has a forming section 20 for forming paperboard with one or more layers, a press section 30 to remove water, a drying section 40 to remove additional water, a multilayer curtain coating section 50, a blade coating section 60, and a reel 70.

Figure 2:
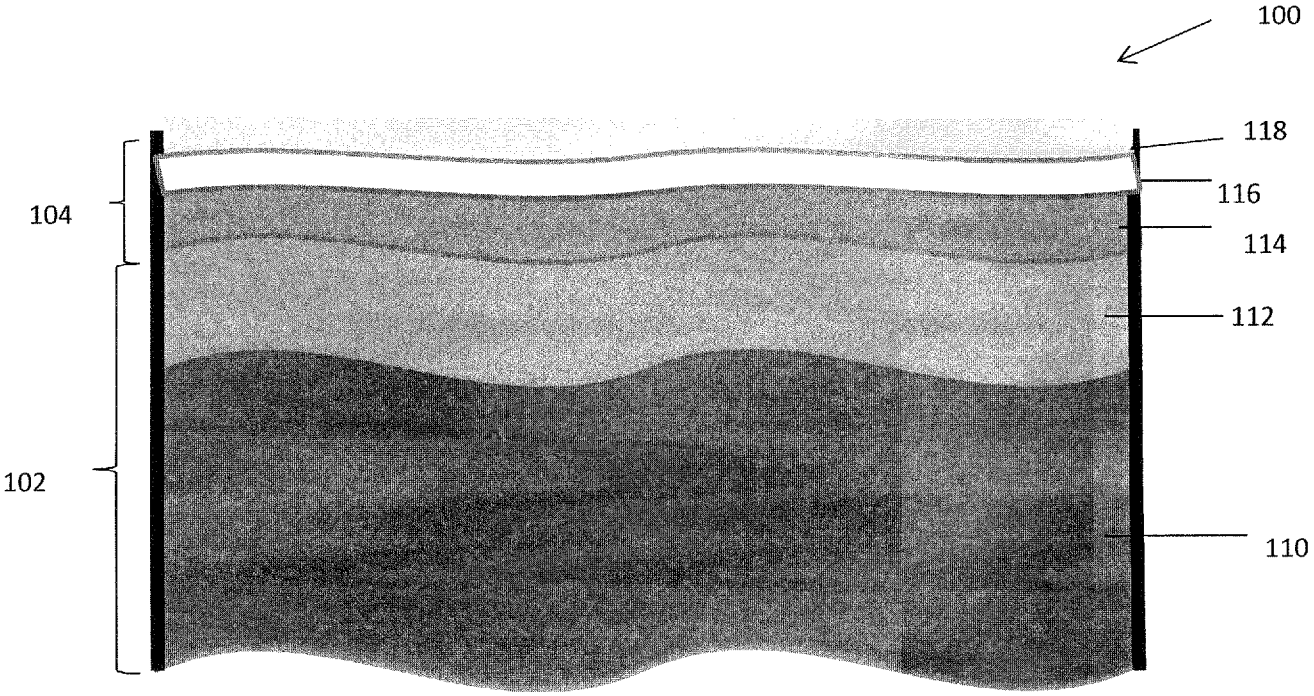
FIG. 2 illustrates a cross-section of one possible configuration for the coated paperboard as taught herein.

FIG. 2 illustrates a cross-sectional view of one embodiment of a coated paperboard 100. The sections of the coated paperboard 100 are colored differently so that each section can be clearly identified. The coated paperboard 100 has a base substrate 102. The base substrate has two fiber layers 110 and 112. A coating layer 104 is covering the base substrate 102. The coating layer 104 has an opaque layer 114, covered by a barrier layer 116, and a top coat 118 covering the barrier layer 116.

Figure 3:
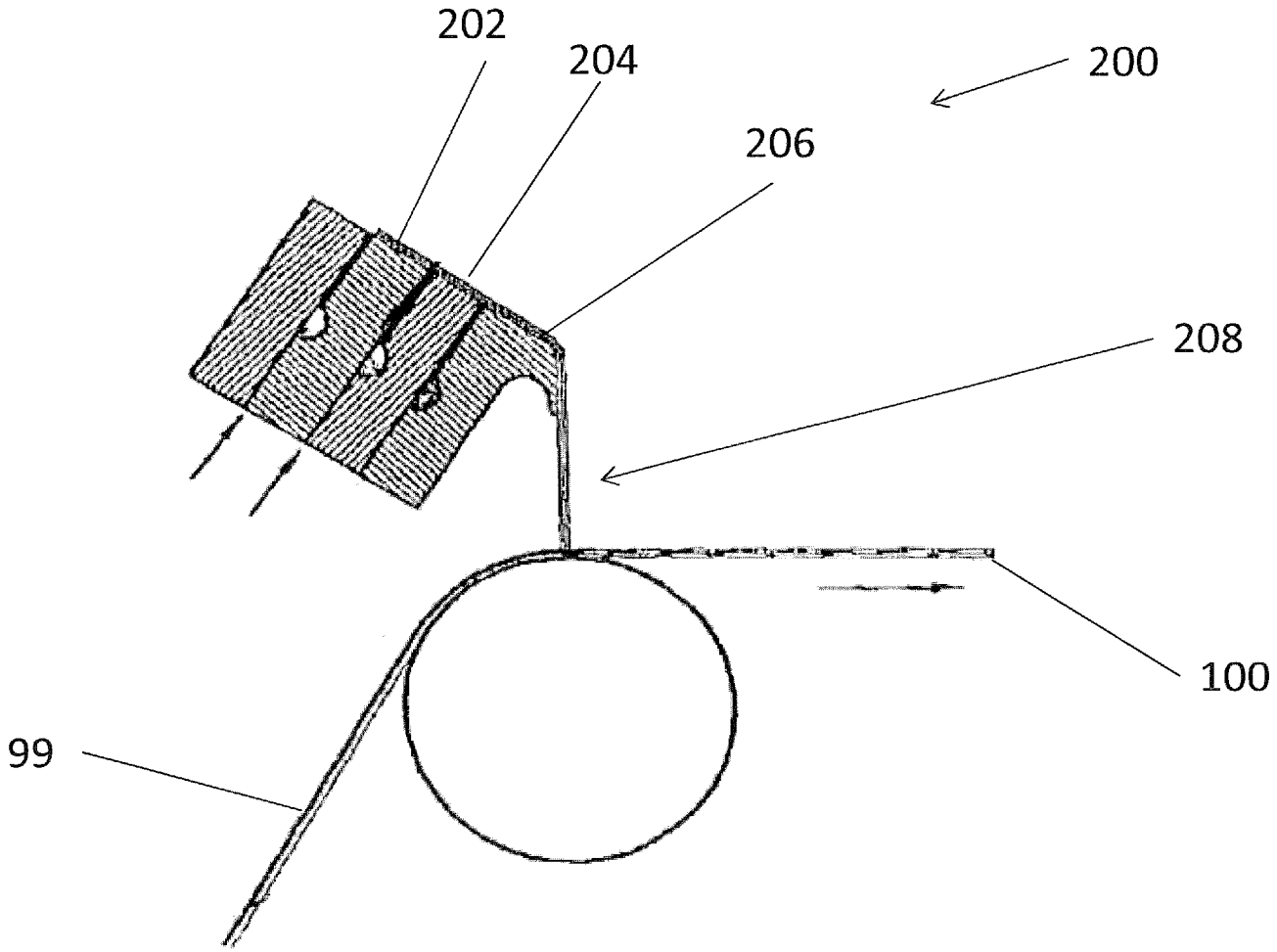
FIG. 3 illustrates a close up of one possible coating system taught herein.

FIG. 3 illustrates a multilayer curtain coating unit 200. The multilayer curtain coating unit 200 includes a first curtain 202, a second curtain 204, and a third curtain 206. The first curtain 202, the second curtain 204, and the third curtain 206 combine to form a single multilayer free flowing curtain 208. The multilayer free flowing curtain 208 falls on an uncoated paperboard 99 and forms a coated paperboard 100.

Figure 4:
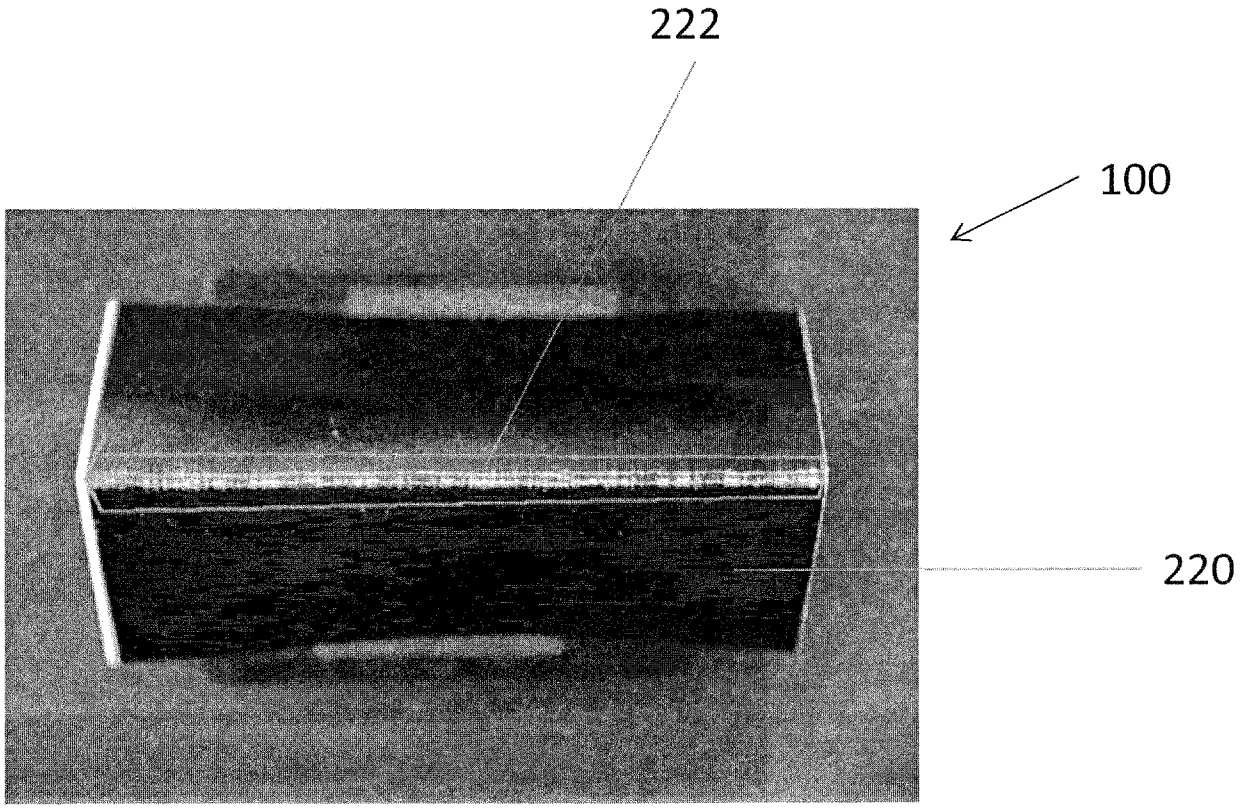
FIG. 4 illustrates an example of a piece of paper after the Fold Crack Area Ratio Test has been performed.

FIG. 4 illustrates an example of a coated paperboard 100 after a Fold Crack Area Ratio Test has been performed. As illustrated the coated paperboard is covered with black ink 220. After the sample is folded the white coating 222 is exposed through the black ink 220 and the total area of the white coating 222 exposed is measured.

EXAMPLES

A precoated base substrate is coated using a pilot coater at the speed of 800 m/min. Four different formulations are used to coat the base substrate having a precoating. The four different formulations are set forth in Table 3.

TABLE 3

| | Formulation 1 | | Formulation 2 | | Formulation 3 | | Formulation 4 | |
|---|---|---|---|---|---|---|---|---|
| | Under | Over | Opaque | Barrier | Opaque | Barrier | Opaque | Barrier |
| Coat Wt g/m$^2$ | 10 | 10 | 19 | 1 | 19 | 2 | 19 | 3 |
| $CaCo_3$ | 60 | 40 | 50 | | 50 | | 50 | |
| Delaminated Clay | 40 | 60 | 50 | | 50 | | 50 | |
| MLE 4001 using a Multi-layer emulsion based on Styrene-Butadiene technology with a $T_g$ of 19° C.[1] | 6 | 10 | 8 | 10 | 8 | 10 | 8 | 10 |
| MLE 4102 using a Multi-layer emulsion based on Styrene-Butadiene technology with a $T_g$ of 19° C.[2]. | 8 | 4 | 6 | | 6 | | 6 | |
| Polyvinyl Alcohol | 1 | 1 | 1 | | 1 | | 1 | |
| A barrier emulsion using Styrene Butadiene base having a $T_g$ of 2° C.[3] | | | | 100 | | 100 | | 100 |

[1]using CAS Nos. 7732-18-5 and 577-11-7.
[2]using CAS Nos. 7732-18-5 and 25322-68-3.
[3]using a CAS No. 26102-56-7.

The two layers are applied simultaneously using a multi-layer curtain coater. Formulation 1 is applied without a barrier layer and is used as the reference formulation for testing. Formulations 2, 3, and 4 have an opaque layer which effectively is a blend of the under layer and the over layer of formulation 1 and a barrier layer having 1, 2 and 3 g/m$^2$ coating the opaque layer. All four formulations are coated with topcoat having 80 parts $CaCo_3$, 20 parts delaminated clay, 10 parts latex, and 1 part poly-vinyl alcohol. The samples with the coating formulations 1, 2, 3, 4 and the top coat are calendered with a softnip calendar and tested.

The four formulations are all tested for brightness using TAPPI T452, Brightness Drop using the Wet Brightness Drop Test described herein, and Fold Crack Area Ratio Test. The results of the tests are listed in Table 4.

TABLE 4

| | Formulation 1 | Formulation 2 | Formulation 3 | Formulation 4 |
|---|---|---|---|---|
| Brightness | 72.49 | 68.75 | 68.63 | 68.60 |
| Wet Brightness Drop | 33.68 | 4.35 | 3.70 | 3.03 |
| Foldcracking[4] (Units: Pixel$^2$) | 14,792 | 14,323 | 13,477 | 11,501 |

[4]Folding towards the coated side.

The results of the testing show that the combination of an opaque layer and barrier layer provides significant wet opacity drop improvement over formulation 1 and lower Foldcracking tendency.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the teachings should, therefore, be determined not with reference to the above description, but should instead be determined with reference to the appended claims, along with the full scope of equivalents to which such claims are entitled. The omission in the following claims of any aspect of subject matter that is disclosed herein is not a disclaimer of such subject matter, nor should it be regarded that the inventors did not consider such subject matter to be part of the disclosed inventive subject matter.

We claim:

1. A coated paperboard comprising:

a. a base substrate having a brightness of about 65 or less measured using TAPPI T452 and b. a coating on at least one side of the base substrate, wherein the coating comprises:

i. one or more opaque layers including a white filler, wherein the opaque layer covers the base substrate so that visibility of the base substrate through the opaque layer is substantially eliminated;

ii. a barrier layer covering the opaque layer;

wherein the barrier layer is applied in a sufficient amount so that the barrier layer substantially prevents aqueous fluids from contacting the opaque layer, and wherein the opaque layer has a sufficient coat weight so that the opaque layer substantially blocks the base substrate from visibility and the coated paperboard has a brightness on the side of the base substrate with the coating of about 65 or more measured using TAPPI T452, and a wet brightness drop, on the side of the base substrate with the coating, of about 30 or less, measured using the wet brightness drop test.

2. The coated paperboard of claim 1, wherein the base substrate is a paperboard having a precoating.

3. The coated paperboard of claim 1, wherein the coating is covered by a top coat.

4. A process comprising:

a. forming a multilayer free flowing curtain;

b. coating the base substrate with the multilayer free flowing curtain so that as the base substrate moves into contact with the free flowing curtain and the multilayer free flowing curtain coats the base substrate forming the coated paperboard of claim 1.

5. The process of claim 4, wherein the one or more opaque layers are a single layer formed by formulating an under layer and an over layer together before the single opaque layer is applied to the base substrate.

6. The process of claim 5, wherein the base substrate is substantially free of bleached kraft paper, deinked pulp, mixed office waste, white fibers or a combination thereof.

7. The process of claim 5, wherein the base substrate is free of a white layer covering the base substrate.

8. The process of claim 5, wherein the one or more opaque layers and the barrier layer are applied to the base paper substantially simultaneously.

9. The process of claim 5, wherein the process includes a step of covering the barrier layer with a top coat layer.

10. The process of claim 9, wherein the top coat layer, the barrier layer, and the one or more opaque layers are all applied substantially simultaneously.

11. The process of claim 9 wherein the top coat layer is applied after the barrier layer and the one or more opaque layers are applied.

12. The process of claim 4, wherein the coat weight of the barrier layer is about 4 $g/m^2$ or less.

13. The process of claim 4, wherein the coat weight of the one or more opaque layers is about 40 $g/m^2$ or less.

14. A system for coating a base substrate comprising:

a. a transport system for feeding a base substrate, having a brightness of about 65 or less measured using TAPPI T452, along a path of travel;

b. a multilayer curtain coating system comprising:

a plurality of free flowing liquid curtains disposed adjacent to the path of travel for forming a coating, wherein coating includes:

a first liquid curtain having a first coating material and a second liquid curtain located downstream of the first liquid coating in the path of travel, the second liquid curtain having a second coating material;

c. an engagement system for selectively bringing the base substrate and the plurality of free flowing liquid curtains into contact; and wherein the first liquid curtain coats the base substrate and forms an opaque layer and the second liquid curtain coats the opaque layer and forms a barrier layer;

wherein the barrier layer is applied in a sufficient amount so that the barrier layer substantially prevents aqueous fluids from contacting the opaque layer; and wherein the opaque layer is applied in a sufficient coat weight so that the opaque layer substantially blocks the base substrate from visibility and the coated base substrate has a brightness on the side of the base substrate with the coating of about 65 or more measured using TAPPI T452, and a wet brightness drop, on the side of the base substrate with the coating, of about 30 or less, measured using the wet brightness drop test.

15. The coated paperboard of claim 2, wherein the coating is covered by a top coat.

16. The process of claim 6, wherein the base substrate is free of a white layer covering the base substrate.

17. The process of claim 7, wherein the one or more opaque layers and the barrier layer are applied to the base paper substantially simultaneously.

18. The process of claim 17, wherein the process includes a step of covering the barrier layer with a top coat layer.

19. The process of claim 18, wherein the top coat layer, the barrier layer, and the one or more opaque layers are all applied substantially simultaneously.

20. The process of claim 18 wherein the top coat layer is applied after the barrier layer and the one or more opaque layers are applied.

* * * * *